United States Patent [19]

Clement

[11] 4,318,485

[45] Mar. 9, 1982

[54] GRAVITY FEED MERCHANDISE DISPENSING DEVICE

[75] Inventor: Joseph Clement, Bradenton, Fla.

[73] Assignee: The Mead Corporation, Dayton, Ohio

[21] Appl. No.: 109,061

[22] Filed: Jan. 2, 1980

[51] Int. Cl.[3] ..... A47F 7/00; B65B 21/06

[52] U.S. Cl. ..... 211/49 D; 211/74; 211/81

[58] Field of Search ..... 211/49 D, 74, 81; 221/242, 311, 194

[56] References Cited

U.S. PATENT DOCUMENTS

| | | | |
|---|---|---|---|
| 2,289,751 | 7/1942 | Brenholt | 211/49 D |
| 2,588,618 | 3/1952 | DiRenzo | 211/49 D |
| 2,620,691 | 12/1952 | Gould | 224/45 |
| 2,880,904 | 3/1959 | Linthicum | 211/74 |
| 3,243,220 | 3/1966 | Karas | 294/87.28 |
| 3,553,927 | 1/1971 | Anglade | 53/250 |
| 4,037,766 | 7/1977 | Iacono | 224/45 |

*Primary Examiner*—Reinaldo P. Machado
*Attorney, Agent, or Firm*—Erwin Doerr

[57] ABSTRACT

A merchandise dispensing device of the gravity feed type in which a track having a pair of rails to receive the neck-flanges of suitable bottles is mounted in a rack. The rails include upturned end portions providing a braking section in which gravity feed is arrested. The tracks include two different sized sets of rails which can be selectively positioned to receive bottles having different neck flanges.

8 Claims, 5 Drawing Figures

GRAVITY FEED MERCHANDISE DISPENSING DEVICE

This invention relates to a merchandise dispensing device of the gravity feed type. The device is particularly useful together with other such devices in forming a compact, automatic feed merchandise display rack.

Merchandise display racks of the gravity feed type are used where it is desirable that articles of merchandise for sale successively are advanced forwardly of the rack so that they are always in view of, and readily accessible to the customer.

In recent years large capacity bottles made from plastics material have been developed for the sale of e.g. soft drinks. Such bottles are tall and relatively light in comparison to their size and do exhibit some degree of instability when free standing, particularly if used on known merchandising display devices.

Many of these large capacity plastics bottles are formed with a projecting flange around the bottle neck used as a gripping element for handling the bottle prior to the point of sale. One aspect of this invention utilizes to advantage the provision of neck flanges on such bottles by providing a merchandising device which allows the bottles to be suspended by their neck flanges.

This aspect of the invention provides a gravity feed merchandise dispensing device comprising a track for supporting in tandem a row of similar bottles of the type having an annular flange on the neck of the bottle, the track comprising a pair of rails spaced apart to receive between them the necks of suitably sized bottles such that the underside of each bottle neck flange engages the rails whereby the bottles are suspended by their flanges for movement relative to the track, the track normally being inclined so as to permit the suspended bottles to gravity feed one after the other to the front of the track as the lead bottles in the row successively are unloaded, and stop means provided adjacent said front end of the track to arrest movement of each lead bottle.

Figure 1:
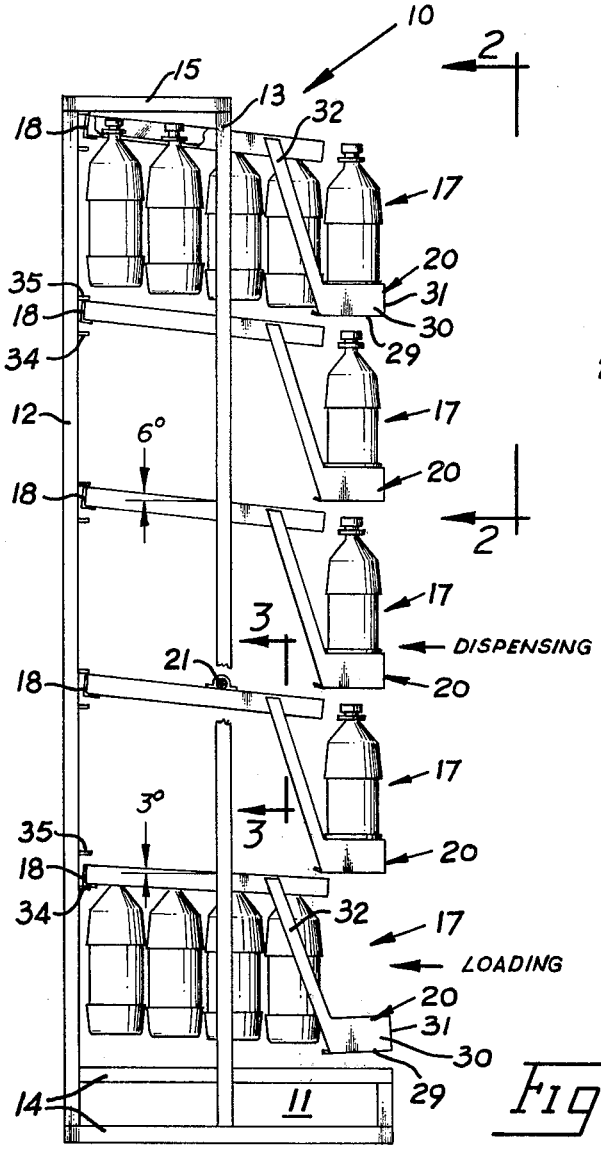
Figure 2:
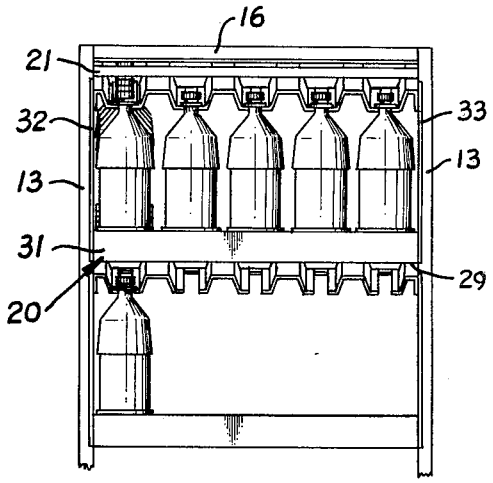
Figure 3:
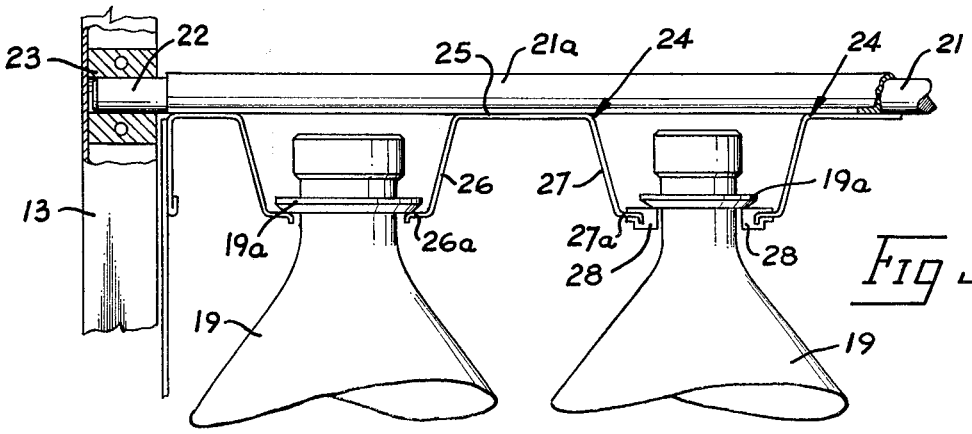
Figure 5:
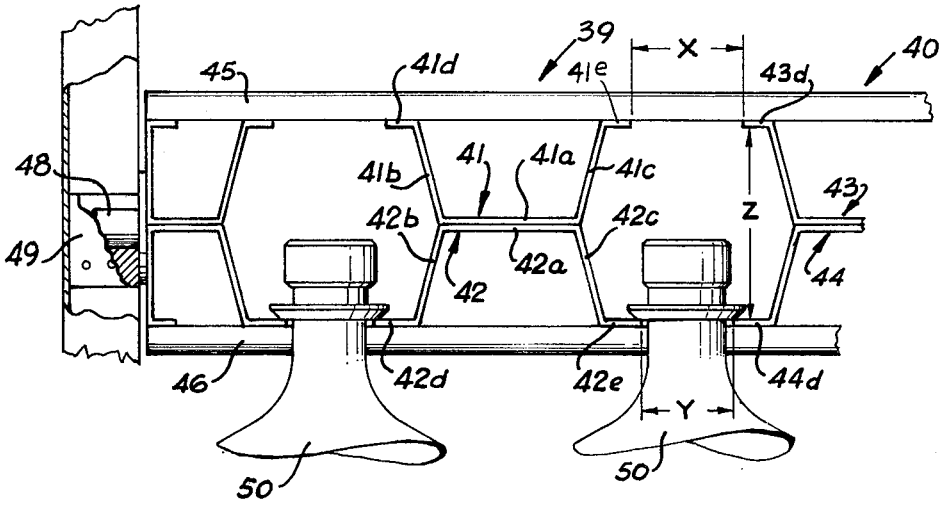
Figure 4:
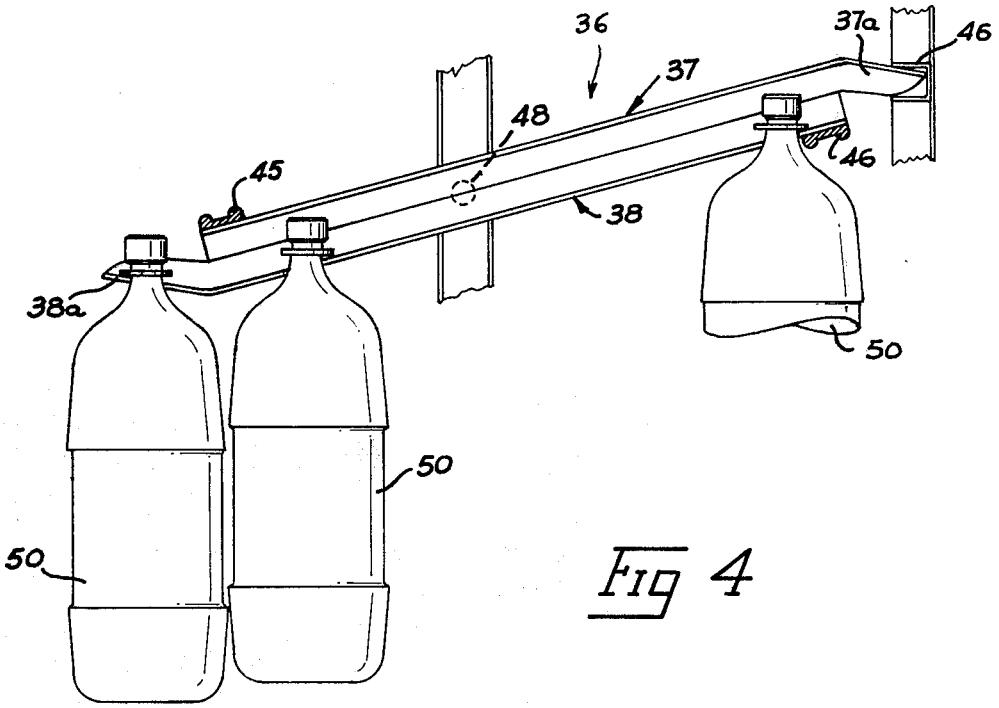

In the following description a preferred embodiment of the invention is described in detail in conjunction with the accompanying drawings, in which:

FIG. 1 shows schematically a side view of a merchandise display rack incorporating a number of vertically spaced gravity feed devices, FIG. 2 is a front view of a top portion of the rack shown in FIG. 1, and FIG. 3 shows in more detail the pivotal mounting of the tracks of a gravity feed device according to the invention, FIG. 4 is a side view of a modified track, and FIG. 5 is a cross-section through a series of modified tracks.

Referring first to FIG. 1 of the drawings, there is shown a merchandise display rack 10 of the gravity feed type comprising a base structure 11 permitting free standing of the rack 10, a pair of spaced back support posts 12 (only one of which is shown) and a pair of spaced front support posts 13 (FIG. 2). The support posts extend vertically from base structure 11 and are connected together by base space bars 14, top spacer bars 15 and front spacer bar 16 (FIG. 2), thereby providing an 'open' frame display rack.

Pivotally mounted within the frame are five sets of vertically spaced gravity feed devices 17. Each device 17 basically comprises a series of five tracks 18 in each of which a row of bottles 19 is supported in tandem for gravity feed to the forward end of rack 10, and stop means comprising a stirrup like structure 20. The series of tracks 18 of each device and their mounting within the rack 10 is shown in more detail in FIG. 3.

Each device 17 includes a track support rod 21 which extends transversely of the tracks and terminates in a trunnion 22 at its opposite ends each of which trunnions are journalled in bearings 23 provided in both front support posts 13. The rod 21 includes a sheath **21*a* from which depend the series of tracks 18. The tracks 18 are welded or otherwise fixed to sheath 21*a*. The track series is formed by a number of elongate components 24 of sheet material having a 'U'-shaped cross-section. The base 25 of the 'U' is connected as by welding to the sheath 21*a* of support rod 21 so as to provide an inverted 'U'-shaped element. The limbs 26, 27 respectively of element 24 terminate in outwardly turned flanges 26*a*, 27*a* each of which provides a rail on which the neck flange 19*a* of a suitable bottle can engage. As can be seen from FIG. 3 the rail pair of each track 18 is provided by adjacent 'U'-elements 24 so that one 'U'-shaped element provides the adjacent rails of neighbouring tracks. Thus, a series of tracks are formed each having a pair of spaced parallel rails on which the neck flange 19*a* of suitable bottles can engage (see FIG. 2). The spacing between adjacent rails of a track can be altered by means of detachable strips 28 (FIG. 3). Strips 28 are pressed onto the free edge of such rail of a pair to decrease the distance between the rails whereby the track can receive a bottle having a relatively small neck flange. Advantageously, the detachable strips 28 are formed from a material having a low coefficient of friction such as Teflon (Registered Trade Mark) to enhance the sliding gravity feed of bottles relative to the track. It is also envisaged that the device 17 comprises only one track 18 or alternately a series of independently pivotable tracks 18. In the latter case the construction shown in FIG. 3 is modified by splitting the sheath 21*a* at appropriate locations between adjacent tracks 18 to provide a series of sheath portions and also separating each 'U'-shaped component along its base 25 so as to provide a pair of track elements. Instead of separating the 'U' components it is also envisaged that the base 25 of the 'U' could be attached intermediate the ends of a sheath portion so that it would be located immediately above the bottle tops, in which case the flanges 26*a*, 27*a*** would be turned inwardly to face one another in order to provide the rails of the track.

The stirrup like structure 20 is provided at the forward end of each device 17 to stop gravity feed movement of the lead bottles in the device, and also to present a bottle to a prospective purchaser and to facilitate loading the device. Each stirrup like structure 20 comprises a support platform 29 having side walls 30 and a front wall 31. The stirrup 20 is supported by arms 32, 33 extending from adjacent the forward end of the first and last tracks 18 in a series of tracks such that the support platform itself is slung below and immediately forward the series of tracks.

When a device is empty, i.e. when no bottles are present on its tracks, the device adopts the position shown by the lowermost device in FIG. 1. In this position the series of tracks 18 are pivoted into a loading configuration, in which the back end of the first and last tracks abuts one stop 34 of a pair of limiting stops 34, 35. The limiting stops 34, 35 are provided to limit the pivotal movement of the series of tracks within the frame structure. However, other appropriate stop devices also are envisaged. For example, sheath 21*a* could be radially slotted to receive a projection carried by rod 21 in order to prevent tilting movement of the device. In the view shown, when the tracks are in abutment with stops 34 they are inclined forwardly at an angle of about 3° to the horizontal. In this loading positions bottles can be loaded one after another onto the tracks by sliding them along the rails without there being a tendency for these bottles to slide forwardly off the tracks. Hence, the gravity feed effect is minimized. The 3° angle at which the tracks are constrained to adopt during loading can, of course, be varied depending on the weight of bottles, the relative coefficient of friction between the bottles and the rails and on a number of other factors.

The fulcrum of the device is chosen such that the series of tracks will be maintained in the loading position until such time as the last lead bottle has been received on the support platform 29 of the stirrup 20.

The condition is shown in the lowermost device of FIG. 1 where all the tracks are fully loaded each with four bottles and bottles have yet to be accommodated in the stirrup 20 to complete the loading of the device. As can be seen, the pivotal mounting of the rod 21 to the front support posts 13 is positioned further toward the forward end of the tracks than the rearward end.

When the last lead bottle has been received in stirrup 20, the series of tracks thus becomes 'front heavy' and the tracks pivot into a dispensing position in which the tracks are inclined forwardly at an angle of about 6° to the horizontal. This 'dispensing' angle may also be changed depending on the load conditions.

Further pivotal movement is restricted by limiting stops 35. In the dispensing position the row of bottles 19 in each track 18 can gravity feed one after the other to the front (stirrup) end of the track as the lead bottles in that row successively are unloaded. When a lead bottle is removed from the stirrup 20 the next succeeding bottle slides along to the forward end of the track and then leaves the track. Immediately upon leaving the track that bottle is received in the stirrup so that the bottle base engages the substantially horizontal support platform 29 whereupon further gravity feed of the bottle is halted. In this location the bottle is presented to a prospective customer. The front wall 31 of the stirrup 20 prevents the lead bottle from overturning and being dislodged from the device.

It is, of course, envisaged that the fulcrum could be positioned elsewhere than as shown depending for example on the load capacity of each device. In some circumstances it may be desirable for the tracks to be inclined rearwardly i.e. reverse tilted to achieve easy loading of the device.

As is shown in FIG. 1 of the drawings a plurality of gravity feed devices 17 can be mounted in vertically spaced relationship within a free-standing frame 10. In the embodiment illustrated there are five such devices each having a series of five tracks holding five bottles each. However, as previously mentioned the device may be used with only a single track if desired.

It is, of course, necessary to ensure that the spacing of adjacent devices is chosen such that the loading and dispensing operation of the one device is not impeded by that of an adjacent device, but at the same time achieving a compact construction with minimum wasted space.

FIGS. 4 and 5 of the drawings show a preferred embodiment comprising a modified track construction in which the stirrup 20 is omitted and in which each track includes two pair of rails. The modified track 36 comprises an upper pair of rails 37 and a lower pair of rails 38 which are connected together as described hereinafter. To arrest movement of each lead bottle the rails 37, 38 are provided with portions 37*a*, 38*a*, respectively, at their front ends which are upturned relative to the remainder of the rails. Thus, unlike the previous embodiment the lead bottles received on the modified tracks do not leave the rails when arriving at their dispensing positions. In the construction the lead bottles gravity feed down the track and are blocked to a stop by causing those bottles to move along an inclined path provided by the upturned front portion of the track. The track construction is shown in more detail in FIG. 5 of the drawings. Each track is provided by a pair of connected track components such as those designated by the reference numerals 39, 40. Track component 39 includes a pair of generally channel section elements 41, 42 each having a base portion 41*a*, 42*a* respectively. Upstanding from base 41*a* is a pair of integral divergent limbs 41*b*, 41*c* which terminate in outwardly projecting flanges 41*d*, 41*e*, respectively. Each of the flanges 41*d* and 41*e* provide an upper rail for adjacent tracks.

Similarly, the channel section element 42 includes a pair of integral divergent limbs 42*b*, 42*c* extending from base 42*a*. The limbs 42*b*, 42*c* terminate in outwardly projecting flanges 42*d*, 42*e* each of which provides a lower rail for adjacent tracks. It will be seen that track component 40 which is only partially shown includes rail flanges 43*d* and 44*d* projecting from channel section elements 43 and 44 respectively.

The flanges 41*e* and 43*d* are spaced apart by a distance 'x' and provide an upper pair of rails on which the neck flange of a suitable bottle can slide. The flanges 42*e* and 44*d* are spaced apart by a distance 'y' and provide a lower pair of rails on which the neck flange of a suitable bottle can slide. Distance 'x' is greater than distance 'y' so that bottles having two different standard diameter neck flanges can be received in the tracks. The distance 'z' is chosen to be such as to provide sufficient space in which to receive the tops of the bottles. Of course, whichever rail size is required for use needs to be located lowermost in the device and this may be achieved simply by removing the rails from the support stand, turning over the tracks and then replacing them in the stand. It is also envisaged that such rail 'reversal' can be achieved by installing each series of tracks so that they are pivotally mounted within the stand in a manner similar to that described with reference to the previous embodiment.

The track components are connected together by means of tie-bars 45, 46 (see FIG. 4). As can be seen tie-bar 45 extends across the rear end of the upper rails 37 and the tie-bar 46 extends across the rear end of the lowermost rails 38.

In order to assemble a series of tracks in a suitable stand such as that shown in FIG. 1 it is simply necessary to provide a suitable channel 47 into which the back ends of the tracks can be slotted (FIG. 4) and a pin and fork assembly 48, 49 respectively, by which the mid-section of the track can be mounted. Naturally, the tracks are assembled in the frame so as to be inclined forwardly of the stand to provide the necessary gravity feed effect. As mentioned the tracks can be pivotally mounted in the frame, in which case the pin and fork assembly 48, 49 could be replaced by a pivotal mounting similar to that described in the previous embodiment. It will be seen in FIG. 4 that the upturned portion of the lower rails projects forwardly of the rear end of the upper rails. This feature of course allows the lead bottles 50 to be disposed in a readily accessible position at the front end of the tracks for removal by a prospective customer. The angle of the incline can of course be varied to increase or decrease the braking effect desired as can the angle at which the tracks are mounted in the stand.

What I claim as my invention is:

1. A gravity feed merchandise dispensing device comprising at least one track, each track having a front and a rear end for supporting in tandem a row of similar bottles of the type having an annular flange on the neck of the bottle, each track also comprising a pair of rails spaced apart to receive between them the necks of suitably sized bottles such that the underside of each bottle neck flange engages the rails whereby the bottles are suspended by their flanges for movement relative to the track, each track normally being inclined towards the front end so as to permit the suspended bottles to gravity feed one after the other to the front end of the track as the lead bottles in the row successively are unloaded, and in which said front end includes a length of track which is upturned relative to the immediately preceding track length to provide a braking section above the plane of said immediately preceding track length along which each lead bottle travels so that it is braked to a stop and presented for removal from said track.

2. A gravity feed device according to claim 1 further comprising support means in which each track is pivotally mounted for tilting movement in a vertical plane from a loading position in which gravity feed towards said front end of the track is minimized so as to facilitate replenishing the device with bottles, to an operative dispensing position in which the gravity feed effect is maintained, means being provided to limit pivotal movement of each track between said loading and dispensing positions.

3. A gravity feed device according to claim 1 in which said device comprises a series of tracks connected together in side by side relationship.

4. A gravity feed device according to claim 1 in which each track comprises a lower pair of rails and an upper pair of rails spaced from said lower pair of rails, the rails of the upper pair being spaced apart by a distance which differs from that between the lower pair of rails and wherein each of said upper and lower pair of rails is upturned to provide said stop means.

5. A gravity feed device according to claim 4 in which the upturned braking section of the lower pair of rails extend beyond the rear end of said upper pair of rails and in which the upturned braking section of the upper pair of rails extends beyond the rear end of said lower pair of rails.

6. A gravity feed device according to claim 5 in which each track is formed from a pair of connected track components, each component including a pair of generally channel shaped elements and each element comprising a base portion, a pair of limbs upstanding from said base portion and a flange extending outwardly from each limb to provide a rail for adjacent tracks, said pair of channel elements being connected together by their bases to form one of said track components, and wherein the distance between the free edges of the flanges of one channel element of the pair differs from that between the free edges of the other channel element of the pair thereby providing the spacing differential between the upper and lower rail pairs in each track.

7. A gravity feed device according to claim 6 further comprising a pair of tie bars connecting together said track components, one of said tie bars extending adjacent the rear end of said upper pair of rails and the other of said tie bars extending adjacent the rear end of said lower pair of rails.

8. A gravity feed device according to claim 4 further comprising a support frame accommodating a plurality of tiers of said series of tracks, adjacent tiers being spaced apart a distance sufficient to permit gravity feed dispensing of bottles received on said tracks and wherein the tracks of each series are reversible so as to present for use one pair of said upper and lower pairs of rails.

* * * * *